US009227208B2

(12) United States Patent
Lin

(10) Patent No.: US 9,227,208 B2
(45) Date of Patent: Jan. 5, 2016

(54) PAINT CUP FOR SPRAY GUN

(71) Applicant: Chin-Hsin Lin, Changhua (TW)

(72) Inventor: Chin-Hsin Lin, Changhua (TW)

( * ) Notice: Subject to any disclaimer, the term of this patent is extended or adjusted under 35 U.S.C. 154(b) by 617 days.

(21) Appl. No.: 13/651,546

(22) Filed: Oct. 15, 2012

(65) Prior Publication Data

US 2014/0103143 A1 Apr. 17, 2014

(51) Int. Cl.

| | |
|---|---|
| ***B05B 9/00*** | (2006.01) |
| ***B05B 7/30*** | (2006.01) |
| ***B05B 9/03*** | (2006.01) |
| ***B05B 7/24*** | (2006.01) |
| ***B05B 9/08*** | (2006.01) |

(52) U.S. Cl.

CPC ..... *B05B 7/2408* (2013.01); *B05B 7/2478* (2013.01); *B05B 9/0894* (2013.01)

(58) Field of Classification Search

CPC ..... B05B 7/2408; B05B 7/2478

USPC ..... 239/345, 379, 600; 220/367.1, 371, 220/372, 202, 203.03

See application file for complete search history.

(56) References Cited

U.S. PATENT DOCUMENTS

| | | | | |
|---|---|---|---|---|
| 3,385,467 | A * | 5/1968 | Lindenberg | 220/374 |
| 3,592,349 | A * | 7/1971 | Baugh | 215/307 |
| 3,672,645 | A * | 6/1972 | Terrels et al. | 366/250 |
| 4,401,268 | A * | 8/1983 | Pomponi, Jr. | 239/142 |
| 4,501,500 | A * | 2/1985 | Terrels | 366/250 |
| 5,649,859 | A * | 7/1997 | Shiga | 454/275 |
| 2007/0018016 | A1 | 1/2007 | Yechouron | |
| 2010/0301049 | A1 | 12/2010 | Buchholz | |
| 2011/0091656 | A1 | 4/2011 | Julien | |
| 2011/0180632 | A1 | 7/2011 | Shkolnikov et al. | |

* cited by examiner

*Primary Examiner* — Len Tran

*Assistant Examiner* — Alexander Valvis

(74) *Attorney, Agent, or Firm* — Che-Yang Chen; Law Office of Michael Chen

(57) ABSTRACT

A paint cup for a spray gun includes a container containing paint solvents, a lid body covering an upper opening of the container, and a ventilation member mounted in the container. The lid body includes an annular coupling portion protruding from an inner surface thereof, an inner rod located in the annular coupling portion, and a vent extending into an annular coupling groove of the annular coupling portion. A gap is formed between the ventilation member and the inner rod. When the container is turned upside-down, the paint solvents in the gap will flow into an accommodating groove formed between the inner rod and the annular coupling portion, and ambient air circulates in the container via the vent and the gap.

8 Claims, 7 Drawing Sheets

PAINT CUP FOR SPRAY GUN

BACKGROUND OF THE INVENTION

1. Field of the Invention

The present invention relates to a paint cup and, more particularly, to a paint cup for a spray gun which features no vent jammed by paint.

2. Description of the Related Art

U.S. Patent Publication No. 2010/0301049 A1 discloses a lid for a closeable mixing cup for a paint gun. The lid is provided with a ventilation opening. The ventilation opening is embodied as a labyrinth seal with three cylinders inserted into each other and allowing air to flow. In a preferred embodiment shown, the three cylinders includes an exterior cylinder embodied in one piece with the lid and extending into an interior space of the mixing cup, an interior cylinder provided inside the exterior cylinder and embodied in one piece with the lid, and a snapping part arranged at the bottom end of the exterior and interior cylinders and including a cylindrical part which projects upwards and falls short of an axial length of the exterior and interior cylinders. The interior cylinder is embodied open towards the top. The cylinder part is inserted with little play into a space between the exterior and interior cylinders and closes the interior of the interior cylinder towards the bottom, but not sealing it completely. Air could enter via the interior cylinder at the bottom end of the interior cylinder into the space between the exterior and interior cylinders, and air can pass the cylinder part and exit again downwards, forming an air bridge from the exterior of the mixing cup and/or lid to the interior space of the mixing cup. This air bridge is easily possible, if the individual dimensions are sized sufficiently small, so that paint located in the interior space of the mixing cup cannot penetrate this path to the outside. However, the gaps between the cylinder part and the exterior and interior cylinders can not be appropriately controlled, so that paint dripping through the labyrinth seal can still occur during shaking of the mixing cup by a user. Furthermore, viscous liquid paint residuals remaining between the exterior cylinder and cylinder part will flow into the bottoms of the exterior cylinder and cylinder part and further flow into the bottoms of the exterior and interior cylinders and adhere to surfaces of all cylinders when the paint cup is reversed again in the case of the paint gun unused or addition of paint. Accordingly, the gaps between the cylinders will be narrowed with time, resulting in an adverse impact on the function of the ventilation opening and even making the paint gun unavailable.

BRIEF SUMMARY OF THE INVENTION

Thus, an objective of the present invention is to provide a paint cup for a spray gun to improve the aforementioned problems. The paint cup of the present invention has a vent to atmosphere to prevent a negative pressure from forming in the paint cup and has an accommodating groove to collect paint solvents to eliminate undesirable dripping of the paint solvents from the vent, thereby keeping airflow circulating in the paint cup and allowing the spray gun to be smoothly operated.

Another objective of the present invention is to provide a paint cup which includes components easily assembled and effectively lowers a product's defect ratio. Further, the components of the paint cup can be assembled or disassembled with a flange and a lip margin joined or separated.

To achieve this and other objectives, a paint cup for a spray gun of the present invention includes a container for containing paint solvents, a lid body, and a tubular ventilation member. The container includes a bottom wall, an annular side wall extending upwards from a periphery of the bottom wall, and an opening in an upper end of the container. The lid body covers the opening of the container and includes an inner surface facing the container and an outer surface opposite to the inner surface. The lid body further includes an annular coupling portion protruding from the inner surface of the lid body in an axial direction. An inner rod extends downwardly from the inner surface of the coupling portion in the axial direction and is located in the annular coupling portion. The inner rod has a length in the axial direction greater than a length of the annular coupling portion in the axial direction. An annular coupling groove is formed in a bottom end of the annular coupling portion and defined between an annular inner wall and an outer periphery of the coupling portion in a radial direction perpendicular to the axial direction. An accommodating groove is formed between the inner rod and the annular inner wall of the annular coupling portion. A vent extends from the outer surface through the inner surface of the lid body and into the annular coupling portion. The tubular ventilation member is mounted around the inner rod, and a gap is formed between the ventilation member and the inner rod. An expansion portion is provided at an upper end of the tubular ventilation member and engaged in the annular coupling groove of the coupling portion. When the container is provided with paint solvents and turned upside-down, the paint solvents in the gap between the ventilation member and the inner rod will flow into the accommodating groove in the coupling portion, and ambient air circulates in the container via the vent and the gap.

In a preferred form, a tubular ventilation portion extends downwardly from the inner surface of the coupling portion in the axial direction and is located in the annular coupling groove of the annular coupling portion. The vent is formed in the tubular ventilation portion, and the tubular ventilation portion has a length in the axial direction smaller than the length of the annular coupling portion in the axial direction. A tubular joint portion extends upwardly from a center of the lid body and is engaged with an adapter ring having a stepped through-hole therein. A plurality of projecting portions is formed on the joint portion, and a plurality of joint hole is formed in a lower end of the adapter ring and coupled with the projecting portions of the joint portion. An external thread is formed on an upper end of the adapter ring for engaging with the spray gun.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
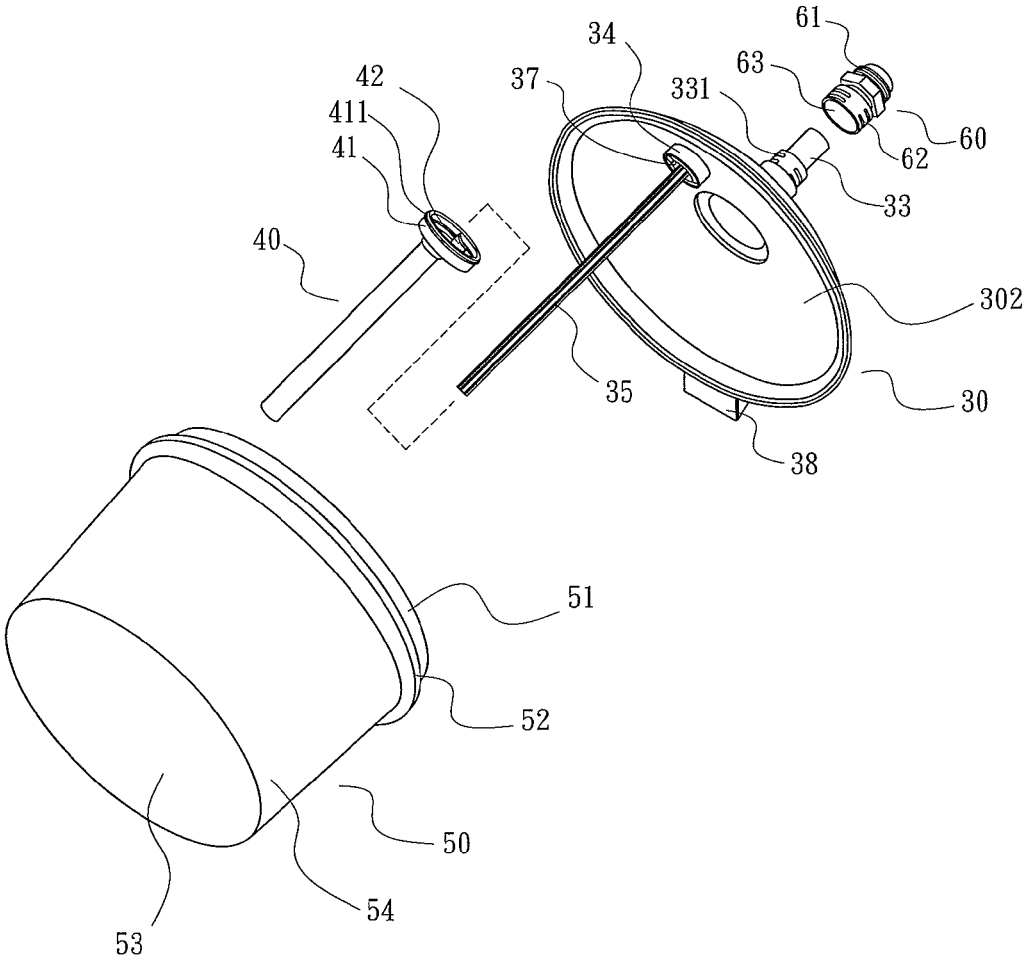
FIG. 1 is an exploded, perspective view of a paint cup for a spray gun of the present invention.
Figure 2:
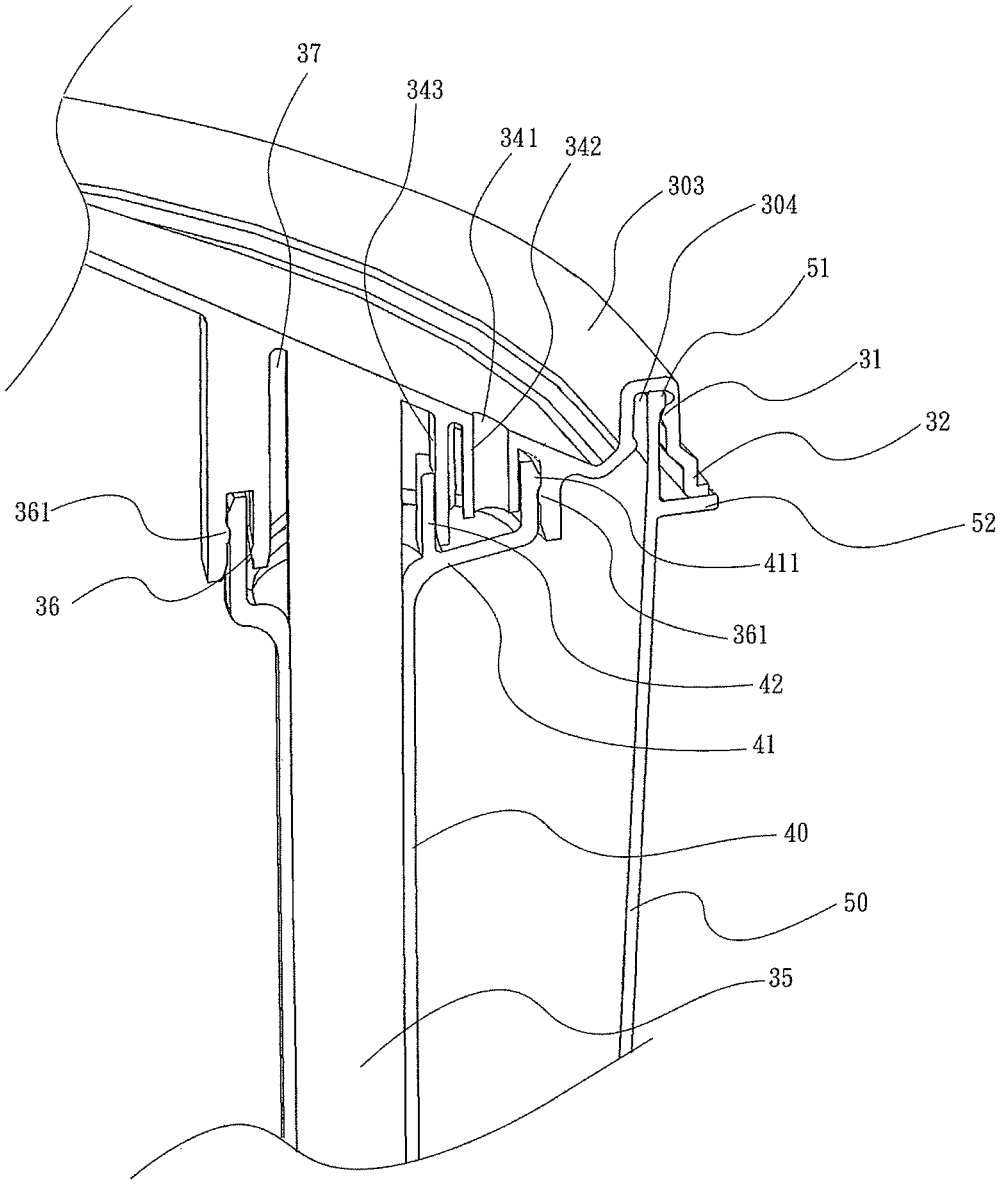
FIG. 2 is a partial, schematic, sectioned view of the paint cup of FIG. 1 which has been assembled.
Figure 3:
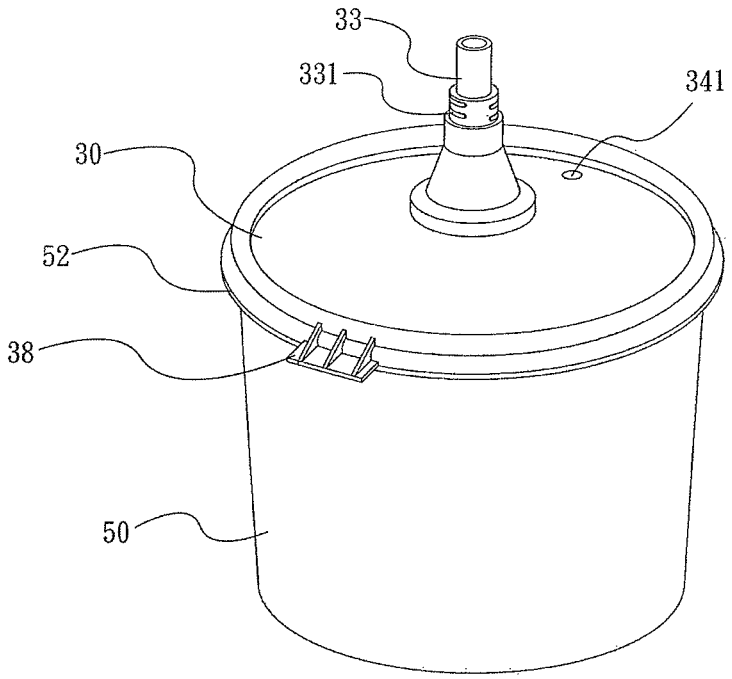
FIG. 3 is a perspective view of the paint cup of FIG. 1, with an adapter ring removed.
Figure 4:
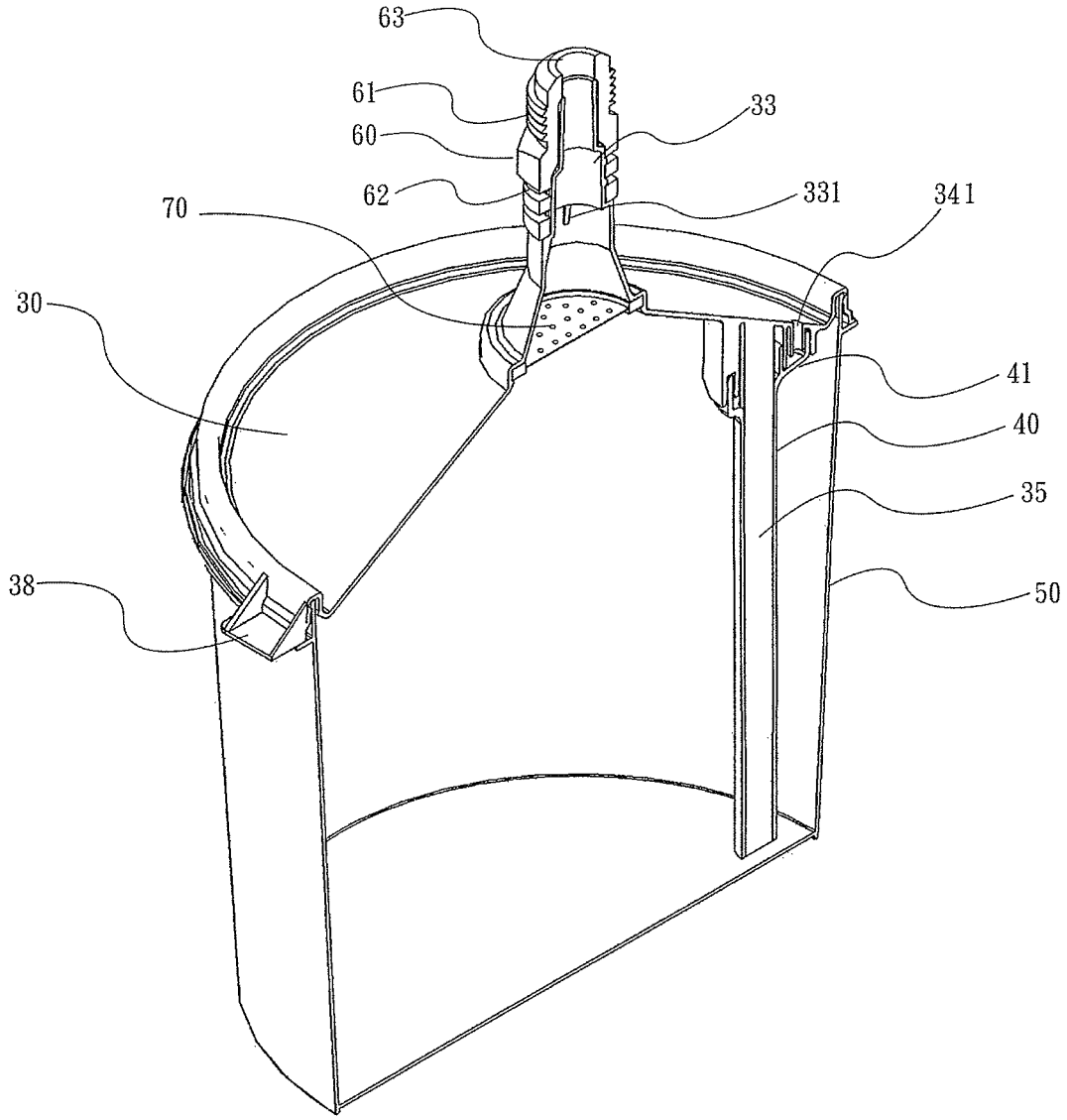
FIG. 4 is a schematic, sectioned view of the paint cup of FIG. 1.
Figure 5:
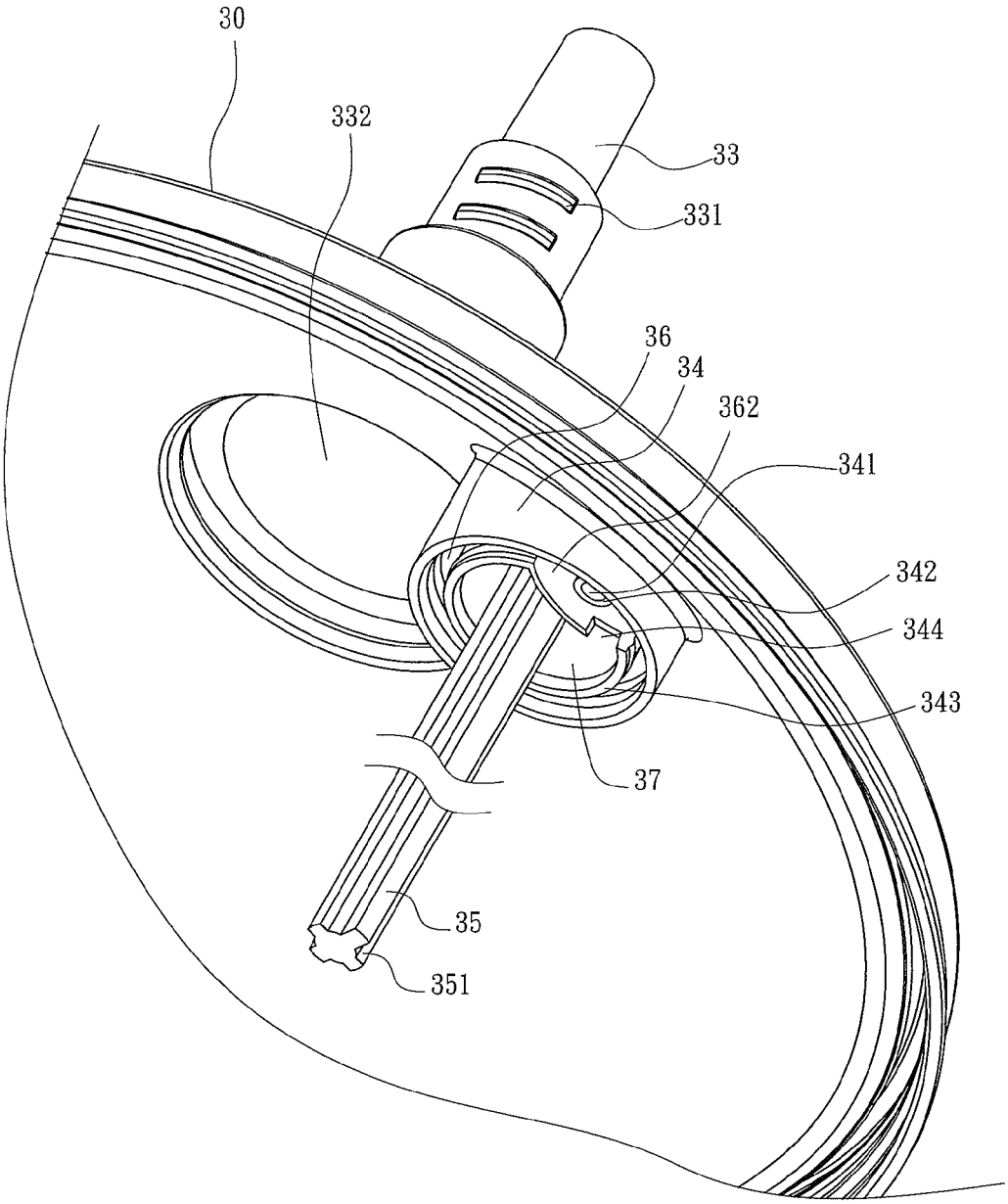
FIG. 5 is partial, enlarged, perspective view of the paint cup of FIG. 3.
Figure 6:
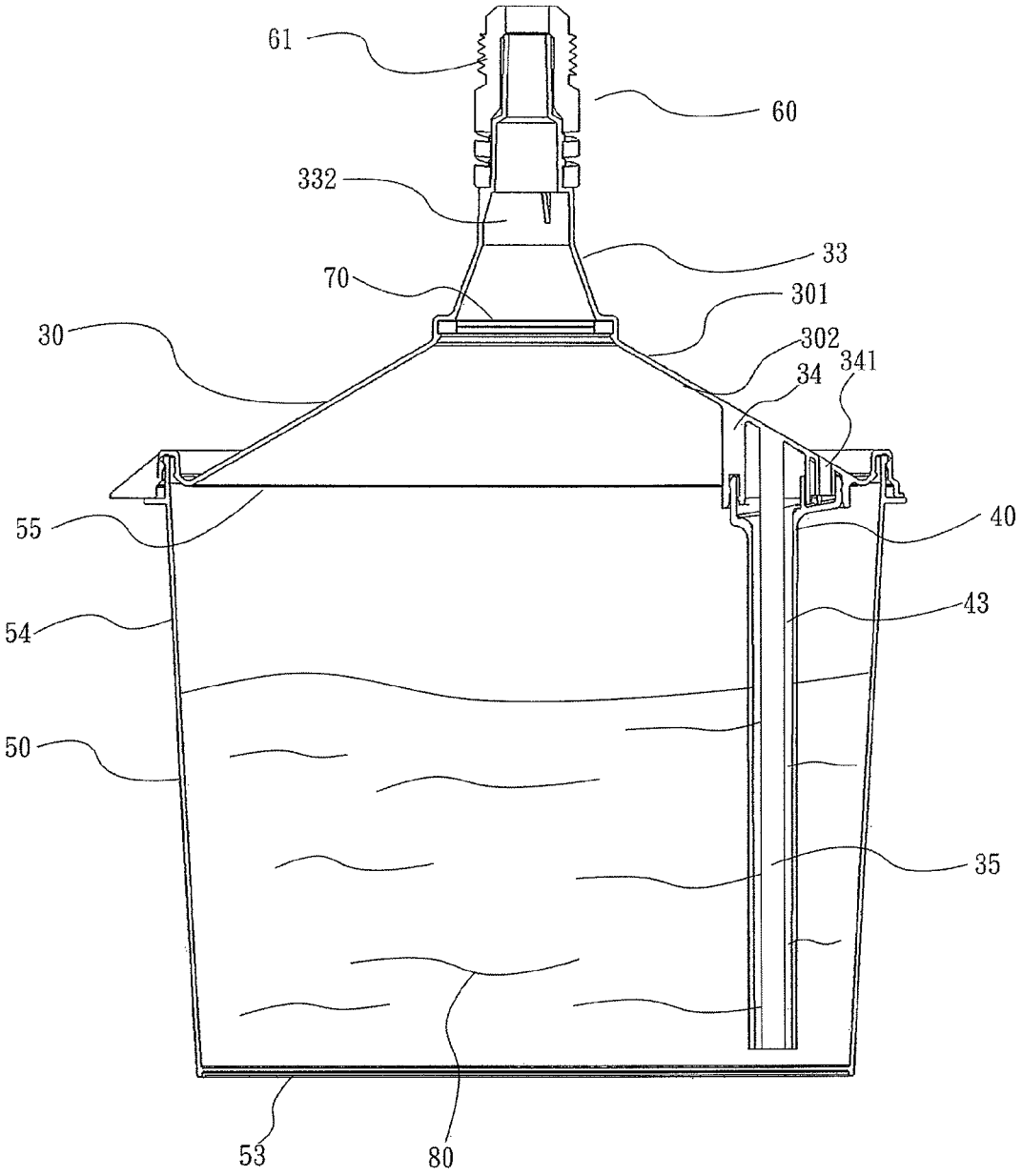
FIG. 6 is schematic, cross-sectional view of the paint cup of FIG. 1, with paint solvents received in a container of the paint cup.

A paint cup for a spray gun according to the present invention is shown in FIGS. 1 through 7 of the drawings and generally includes a container 50, a lid body 30, and a ventilation member 40. The container 50 is used to contain a material to be sprayed such as paint solvents 80 or the like. The container 50 includes a bottom wall 53, an annular side wall 54 extending upwards from a periphery of the bottom wall 53, and an opening 55 in an upper end thereof. A lip margin 51 is formed on an upper portion of the side wall 54 and around the opening 55. A ledge 52 is protruded outwards from the upper portion of the side wall 54 and adjacent to the opening 55.

The lid body 30 is used to cover the opening 55 of the container 50 and includes an inner surface 302 facing the container 50 and an outer surface 301 opposite to the inner surface 302. The lid body 30 further includes an annular flange 303 formed on a periphery thereof and having an annular groove 304 therein. An annular projection 31 is formed on a groove wall of the annular groove 304, and a brim 32 is formed on an outer, lower end of the annular flange 303. The upper portion of the side wall 54 of the container 50 is inserted into the annular groove 304 of the annular flange 303, with the projection 31 snapping or engaging with the lip margin 51 of the container 50 and with the brim 32 abutting the ledge 52 of the container 50. A pulling member 38 is formed on the brim 32 for simple assembly/disassembly of the lid body 30 with the container 50. Further, a tubular joint portion 33 with an inner hole 332 extends upwardly from a center of the lid body 30 and is engaged with an adapter ring 60. A strainer 70 is mounted in the inner hole 332 of the joint portion 33. In this embodiment, a stepped through-hole 63 is formed in the adapter ring 60 so that the adapter ring 60 can be convenient and firmly coupled with the joint portion 33 of the lid body 30. A plurality of projecting portions 331 is formed on the joint portion 33, and a plurality of joint hole 62 is formed in a lower end of the adapter ring 60 for coupling the projecting portions 331 of the joint portion 33 and conveniently positioning and fastening the adapter ring 60 on the lid body 30. The adapter ring 60 further includes an external thread 61 formed on an upper end thereof for engaging with a spray gun (not shown).

The lid body 30 further includes an annular coupling portion 34 protruding from the inner surface 302 of the lid body 30 in an axial direction. An inner rod 35 extends downwardly from the inner surface 302 of the coupling portion 34 in the axial direction and is located in the annular coupling portion 34. The inner rod 35 has a length in the axial direction greater than that of the annular coupling portion 34 in the axial direction. In this embodiment, the inner rod 35 has cross-shaped cross sections and includes a plurality of recessed grooves 351 extending in the axial direction. An annular coupling groove 36 is formed in a bottom end of the coupling portion 34 and defined between an annular inner wall 343 and an outer periphery of the coupling portion 34 in a radial direction perpendicular to the axial direction. An accommodating groove 37 is formed between the inner rod 35 and the annular inner wall 343 of the coupling portion 34 in the radial direction. Furthermore, a notch 344 is formed in the annular inner wall 343, and at least one annular coupling flange 361 is formed on a groove wall of the annular coupling groove 36. A tubular ventilation portion 342 with a vent 341 extends downwardly from the inner surface 302 of the coupling portion 34 in the axial direction and is located in an enlarged portion 362 of the annular coupling groove 36 of the annular coupling portion 34. The tubular ventilation portion 342 has a length in the axial direction smaller than that of the annular coupling portion 34 in the axial direction. The vent 341 extends from the outer surface 301 through the inner surface 302 of the lid body 30.

The ventilation member 40 is in the form of a tube and includes an expansion portion 41 at an upper end thereof. In this embodiment, at least a lip 411 is formed around an outer periphery of the expansion portion 41. The ventilation member 40 is mounted around the inner rod 35 by inserting the expansion portion 41 into the annular coupling groove 36 of the coupling portion 34, with the lip 411 of the expansion portion 41 engaged with the coupling flange 361 of the annular coupling groove 36. Thus, the ventilation member 40 is fastened to the coupling portion 34, and the ventilation member 40 surrounds the inner rod 35 such that a gap 43 is formed between the ventilation member 40 and the inner rod 35 for ambient air circulating into the container 50 via the gap 43. The ventilation member 40 further includes a lower end (unlabeled) adjacent to and spaced from the bottom wall 53 of the container 50. Further, a baffle 42 extends upwards from a lower wall of the expansion portion 41 and abuts the annular inner wall 343 of the coupling portion 34 adjacent to the notch 344.

Figure 7:
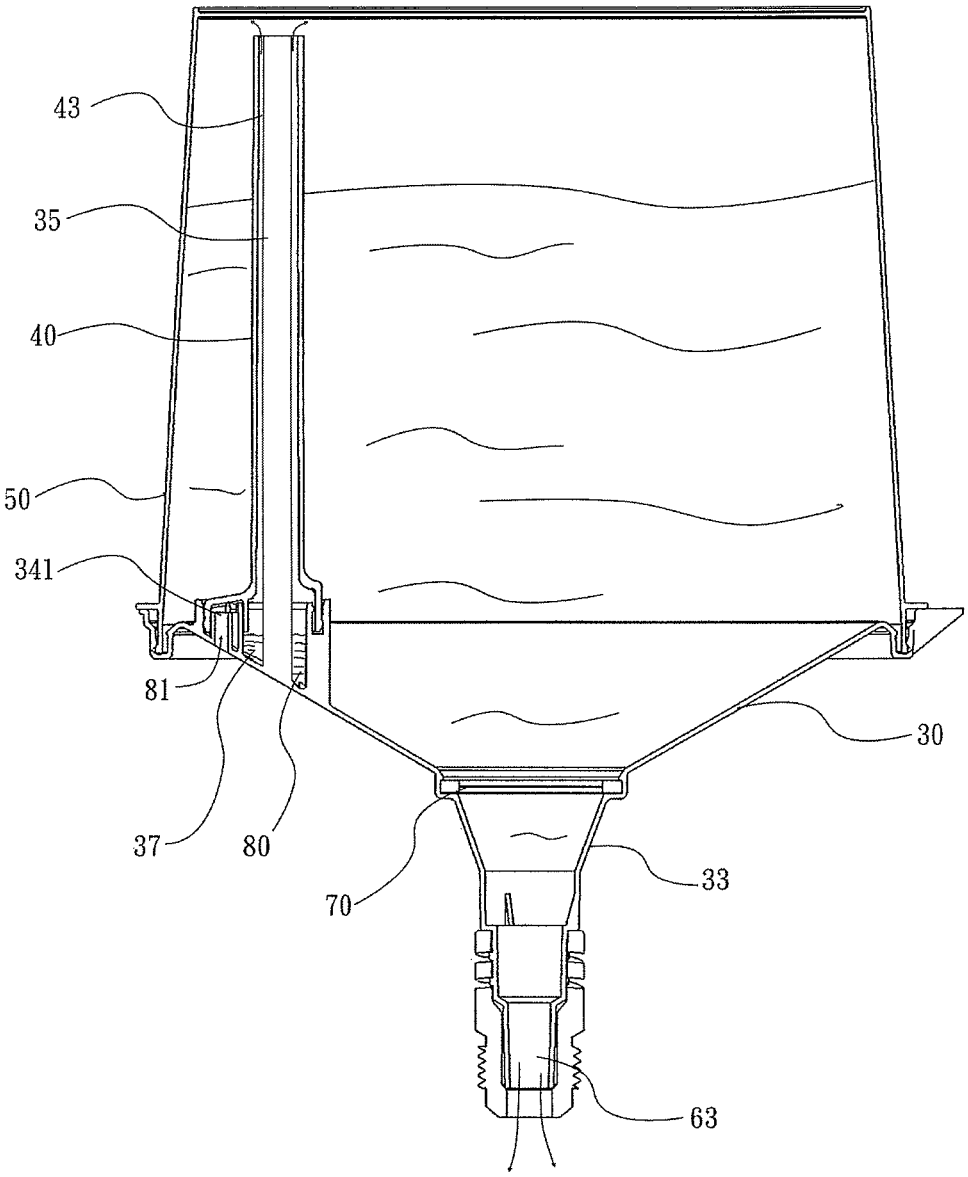
FIG. 7 is a schematic, cross-sectional view similar to FIG. 6, with the paint cup of FIG. 6 turned upside-down.

In use of painting, the paint cup of the present invention is screwed onto the spray gun and turned upside-down. As shown in FIG. 7, while painting, the paint solvents 80 originally held in the gap 43 between the ventilation member 40 and the inner rod 35 will flow into and build up in the accommodating groove 37 for a longer period of operation of the spray gun without making the paint solvents 80 flow into the tubular ventilation portion 342, and ambient air circulates in the container 50 via the vent 341, the coupling groove 36, the notch 344 and the gap 43 without negative pressure induced inside the container 50. Namely, when the container 50 engaging the spray gun is reversed, ambient air passing through the vent 341 is guided into the container 50 through the coupling groove 36 and gap 43 (see the arrow 81 in FIG. 7). Accordingly, the paint solvents 80 which successfully pass through the strainer 70, the joint portion 33 of the lid body 30 and the through-hole 63 of the adapter ring 60 will smoothly flow into the spray gun for painting of the spray gun. The baffle 42 is able to further prevent the paint solvents 80 in the accommodating groove 37 from entering into the vent 341. In addition, the functions of the vent 341 are not affected by viscous liquid paint which has adhered to the ventilation member 40 and the inner rod 35 because the gap 43 defined by the recessed grooves 351 of inner rod 35 has a relatively large size in contrast to the above-mentioned prior labyrinth ring with a smaller gap.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A paint cup for a spray gun, comprising:

a container adapted for containing paint solvents and including a bottom wall, an annular side wall extending upward from a periphery of the bottom wall, and an opening in an upper end of the container;

a lid body covering the opening of the container and including an inner surface facing the container and an outer surface opposite to the inner surface, with the lid body further including an annular coupling portion protruding from the inner surface of the lid body in an axial direction, with an inner rod extending downwardly from the inner surface of the coupling portion in the axial direction and located in the annular coupling portion, with the inner rod having a length in the axial direction greater than a length of the annular coupling portion in the axial direction, with an annular coupling groove formed in a bottom end of the annular coupling portion and defined between an annular inner wall and an outer periphery of the coupling portion in a radial direction perpendicular to the axial direction, with an accommodating groove formed between the inner rod and the annular inner wall of the annular coupling portion, with a vent extending from the outer surface through the inner surface of the lid body and into the annular coupling groove of the annular coupling portion; and a tubular ventilation member mounted around the inner rod and including an expansion portion at an upper end of the tubular ventilation member, with the expansion portion engaged in the annular coupling groove of the coupling portion, with a gap formed between the tubular ventilation member and the inner rod, wherein when the container is provided with paint solvents and turned upside-down, the paint solvents in the gap between the ventilation member and the inner rod flow into the accommodating groove of the coupling portion, and ambient air circulates in the container via the vent, the annular coupling groove, and the gap, wherein a tubular ventilation portion extends downwardly from the inner surface of the coupling portion in the axial direction and is located in the annular coupling groove of the annular coupling portion; and a vent is formed in the tubular ventilation portion, which has a length in the axial direction smaller than the length of the annular coupling portion in the axial direction.

2. The paint cup according to claim 1, with a tubular joint portion extending upwardly from a center of the lid body and engaged with an adapter ring, with a plurality of projecting portions formed on the joint portion, with a plurality of joint holes formed in a lower end of the adapter ring and coupling the projecting portions of the joint portion, with an external thread formed on an upper end of the adapter ring for engaging with a spray gun.

3. The paint cup according to claim 1, with a lip margin formed on an upper portion of the side wall and around the opening of the container, with a ledge protruded outwards from the upper portion of the side wall and adjacent to the opening of the container, with the lid body further including an annular flange on a periphery of the lid body, with the annular flange including an annular groove therein, with an annular projection formed on a groove wall of the annular groove, with a brim formed on an outer, lower end of the annular flange, with the upper portion of the side wall of the container engaged in the annular groove of the annular flange, with the projection engaging the lip margin of the container, with the brim abutting the ledge of the container.

4. The paint cup according to claim 3, with an annular coupling flange formed on a groove wall of the annular coupling groove, with a lip formed around an outer periphery of the expansion portion and engaged with the coupling flange of the annular coupling groove.

5. The paint cup according to claim 2, with the inner rod including a plurality of recessed grooves extending in the axial direction, with a baffle extending upward from a lower wall of the expansion portion and abutting the annular inner wall of the lid body.

6. The paint cup according to claim 5, with a lip margin formed on an upper portion of the side wall and around the opening of the container, with a ledge protruded outwards from the upper portion of the side wall and adjacent to the opening of the container, with the lid body further including an annular flange on a periphery of the lid body, with the annular flange including an annular groove therein, with an annular projection formed on a groove wall of the annular groove, with a brim formed on an outer, lower end of the annular flange, with the upper portion of the side wall of the container engaged in the annular groove of the annular flange, with the projection engaging the lip margin of the container, with the brim abutting the ledge of the container, with a notch formed in the annular inner wall.

7. The paint cup according to claim 5, with an annular coupling flange formed on a groove wall of the annular coupling groove, with a lip formed around an outer periphery of the expansion portion and engaged with the coupling flange of the annular coupling groove, with a pulling member formed on the brim for simple assembly/disassembly of the lid body with the container.

8. The paint cup according to claim 5, with an annular coupling flange formed on a groove wall of the annular coupling groove, with a lip formed around an outer periphery of the expansion portion and engaged with the coupling flange of the annular coupling groove, with a strainer mounted in an inner hole of the joint portion.

* * * * *